US006315946B1

(12) United States Patent
Focht

(10) Patent No.: US 6,315,946 B1
(45) Date of Patent: Nov. 13, 2001

(54) ULTRA LOW CARBON BAINITIC WEATHERING STEEL

(75) Inventor: Eric M. Focht, Falls Church, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/421,886

(22) Filed: Oct. 21, 1999

(51) Int. Cl.[7] ..... C22C 38/42; C22C 38/48; C22C 38/50

(52) U.S. Cl. ..... 420/112; 420/109; 420/91; 148/332; 148/333; 148/335

(58) Field of Search ..... 420/112, 109, 420/91; 148/332, 333, 335

(56) References Cited

U.S. PATENT DOCUMENTS

| | | | | |
|---|---|---|---|---|
| 2,102,283 | | 12/1937 | Saklatwalla | 75/125 |
| 2,392,917 | | 1/1946 | Guinee | 29/189 |
| 2,677,625 | | 5/1954 | Eckel | 117/53 |
| 3,152,934 | | 10/1964 | Lula et al. | 148/136 |
| 3,247,946 | | 4/1966 | Klein | 148/12.3 |
| 3,328,211 | | 6/1967 | Nakamura | 148/12 |
| 3,340,102 | | 9/1967 | Kulin et al. | 148/12.4 |
| 3,365,343 | | 1/1968 | Vordahl | 75/125 |
| 3,438,822 | | 4/1969 | Allen | 148/143 |
| 3,592,633 | | 7/1971 | Osuka et al. | 75/124 |
| 3,620,717 | | 11/1971 | Sekino et al. | 75/125 |
| 3,713,905 | | 1/1973 | Philip et al. | 148/36 |
| 3,720,087 | | 3/1973 | Gottschlich | 72/364 |
| 3,945,858 | | 3/1976 | Matsubara et al. | 451/953 |
| 3,955,971 | | 5/1976 | Reisdorf | 75/124 |
| 4,050,959 | | 9/1977 | Nakaoka et al. | 148/12.3 |
| 4,094,670 | | 6/1978 | Bruno et al. | 75/124 |
| 4,145,235 | | 3/1979 | Bondo et al. | 148/12 |
| 4,219,371 | * | 8/1980 | Nakasugi et al. | 148/330 |
| 4,261,768 | | 4/1981 | Wallner | 148/36 |
| 4,391,653 | | 7/1983 | Takechi et al. | 148/12 C |
| 4,406,711 | | 9/1983 | Nagumo et al. | 148/2 |
| 4,437,891 | | 3/1984 | Umino et al. | 75/251 |
| 4,534,805 | | 8/1985 | Jesseman | 148/12.3 |
| 5,352,304 | | 10/1994 | DeArdo et al. | 148/336 |
| 5,545,269 | * | 8/1996 | Koo et al. | 148/654 |
| 5,769,974 | | 6/1998 | Masteller et al. | 148/651 |
| 5,817,275 | | 10/1998 | Ogawa et al. | 420/90 |
| 5,910,223 | | 6/1999 | Tipton et al. | 148/210 |
| 6,066,212 | * | 5/2000 | Koo et al. | 148/654 |

* cited by examiner

*Primary Examiner*—Deborah Yee

(57) ABSTRACT

An ultra-low carbon weathering steel has a carbon content of from about 0.015 wt % to about 0.035 wt %; a copper content of from about 0.20 wt % to about 0.40 wt %; a chromium content of from about 0.40 wt % to about 0.70 wt %; a nickel content of from about 0.20 wt % to about 0.50 wt %; a titanium content of from about 0.02 wt % to about 0.05 wt %; a niobium content of from about 0.03 wt % to about 0.06 wt %; a boron content of from about 0.0015 wt % to about 0.003 wt %; a manganese content of from about 2.0 wt % or less; a phosphorous content of from about 0.012 wt % or less; a sulphur content of from about 0.005 wt % or less; a silicon content of from about 0.40 wt % or less; a molybdenum content of from about 0.50 wt % or less; a vanadium content of from about 0.10 wt % or less; an aluminum content of from about 0.03 wt % or less; and a nitrogen content of from about 0.006 wt % or less. The steel is formed by austenitizing a steel slab, conditioning the austenite microstructure of the steel slab at a deforming temperature between the austenitizing temperature and the austenite recrystallization stop temperature followed by deforming the austenite microstructure at a temperature below the austenite recrystallization stop temperature and above the $Ar_3$ temperature of the slab, deforming the slab to a minimum reduction ratio below the austenite recrystallization stop temperature of from about 2.5:1 or more to form a steel plate and cooling the steel plate to ambient temperature.

23 Claims, No Drawings

ULTRA LOW CARBON BAINITIC WEATHERING STEEL

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention includes ultra low carbon steel compositions. More particularly, the ultra low carbon steel compositions are weathering steels having ultra low carbon compositions with copper, chromium, nickel, titanium, niobium and boron components. Most particularly, the steel of the present invention exhibits good weldability and low temperature fracture toughness at a minimum yield strength of 65,000 psi in plate sections of two inch thickness. The ultra low carbon compositions are useful in structural steel applications, such as ship and highway bridge construction.

2. Brief Description of the Related Art

Ultra low carbon bainitic (ULCB) steels rely on extremely low carbon contents and high hardenability to obtain good combinations of strength and toughness due to the fine bainitic ferrite that forms and the limited, and possibly nonexistent, amount of carbides. High strength and toughness are obtained in a ULCB steel with proper plate processing. Typical ULCB steels have high levels of nickel and molybdenum to obtain the required hardenability while other ULCB steels rely on boron microalloying.

Weathering steels are known, as are the advantages inherent in their use. Weathering steels develop a thin film of oxide that protects the underlying metals from further oxidation. As such, the weathering steel forms its own protective coating and does not require a separate covering. Paint protection against corrosion is not required of the weathering steels, allowing for ease of maintenance once incorporated into a structure. The thickness of the metal oxide layer generally is less than 0.1 mm, requiring between two and four years to form and stabilize. Weathering steels are economically desirable despite the higher cost relative to plain carbon steel. Weathering steels possess several drawbacks in addition to initial cost. After two or four years, the final appearance of the exposed surface may look rusty or otherwise unattractive. Additionally, the toughness of weathering steels is generally not dependably reproducible, limiting their use.

There is a need in the art to provide ultra low carbon weathering steel having good weldability and low temperature fracture toughness for structural steel applications. The present invention addresses this and other needs.

SUMMARY OF THE INVENTION

The present invention includes an ultra-low carbon weathering steel comprising a steel having a carbon content of from about 0.015 wt % to about 0.035 wt %; a copper content of from about 0.20 wt % to about 0.40 wt %; a chromium content of from about 0.40 wt % to about 0.70 wt %; a nickel content of from about 0.20 wt % to about 0.50 wt %; a titanium content of from about 0.01 wt % to about 0.05 wt %; a niobium content of from about 0.03 wt % to about 0.06 wt %; a boron content of from about 0.0015 wt % to about 0.003 wt %; a manganese content of from about 2.0 wt % or less; a phosphorous content of from about 0.012 wt % or less; a sulphur content of from about 0.005 wt % or less; a silicon content of from about 0.40 wt % or less; a molybdenum content of from about 0.50 wt % or less; a vanadium content of from about 0.10 wt % or less; an aluminum content of from about 0.03 wt % or less; and a nitrogen content of from about 0.006 wt % or less.

The invention also includes an ultra-low carbon weathering steel product made by the process comprising the steps of austenitizing a steel slab comprising a steel having a carbon content of from about 0.015 wt % to about 0.035 wt %; a copper content of from about 0.20 wt % to about 0.40 wt %; a chromium content of from about 0.40 wt % to about 0.70 wt %; a nickel content of from about 0.20 wt % to about 0.50 wt %; a titanium content of from about 0.01 wt % to about 0.05 wt %; a niobium content of from about 0.03 wt % to about 0.06 wt %; a boron content of from about 0.0015 wt % to about 0.003 wt %; a manganese content of from about 2.0 wt % or less; a phosphorous content of from about 0.012 wt % or less; a sulphur content of from about 0.005 wt % or less; a silicon content of from about 0.40 wt % or less; a molybdenum content of from about 0.50 wt % or less; a vanadium content of from about 0.10 wt % or less; an aluminum content of from about 0.03 wt % or less; and a nitrogen content of from about 0.006 wt % or less; conditioning the austenite microstructure of the steel slab at a deforming temperature between the austenitizing temperature and the austenite recrystallization stop temperature followed by deforming the austenite microstructure at a temperature below the austenite recrystallization stop temperature and above the $Ar_3$ temperature of the slab; deforming the slab to a minimum reduction ratio below the austenite recrystallization stop temperature of from about 2.5:1 or more to form a steel plate; and, cooling the steel plate to ambient temperature.

Furthermore, the present invention includes a method of forming an ultra-low carbon weathering steel comprising the steps of austenitizing a steel slab, conditioning the austenite microstructure of the steel slab at a deforming temperature between the austenitizing temperature and the austenite recrystallization stop temperature followed by deforming the austenite microstructure at a temperature below the austenite recrystallization stop temperature and above the $Ar_3$ temperature of the slab, deforming the slab to a minimum reduction ratio below the austenite recrystallization stop temperature of from about 2.5:1 or more to form a steel plate; and, cooling the steel plate to ambient temperature.

DETAILED DESCRIPTION OF THE PREFERRED EMBODIMENT

The present invention provides an ultra low carbon weathering steel composition, and a method of its manufacture, that is useful in structural applications, such as Navy and commercial ships, buildings, automobiles, offshore rigs, pipelines, highway bridges, and other similar constructions requiring particular structural integrity. The ultra low carbon steel compositions contain copper, chromium, nickel, titanium, niobium and boron components that impart good weldability and low temperature fracture toughness.

The ultra-low carbon weathering steel of the present invention includes a steel having components of carbon (C), copper (Cu), chromium (Cr), nickel (Ni), titanium (Ti), niobium (Nb) and boron (B). Steel within the meaning of the present invention includes an iron based composition having substantially the balance of the steel composition comprising iron. Impurities may be present within the steel composition that do not interfere with the properties imparted by the carbon, copper, chromium, nickel, titanium, niobium and boron.

Carbon is very effective at imparting strength to steel. The amounts retained in the present invention are considered ultra-low compared to mild steels. Thus, other means such as alloying and processing are utilized to strengthen the steel. The ultra-low carbon level retained in the present invention improves weldability and low-temperature toughness by lowering the hardenability of the steel and reducing carbide formation, respectively. The preferred amount of carbon ranges from about 0.015 wt % to about 0.035 wt %, with more preferred amounts from about 0.015 wt % to about 0.025 wt %, and most preferred amounts from about 0.015 wt % to about 0.020 wt %.

Copper improves hardenability and provides an effective precipitation hardening element. When copper is incorporated in an amount of less than 0.20%, there is no substantial effect of the copper addition. Copper is effective to improve the weathering characteristics as well as to raise the strength level of the steel, but tends to develop hot shortness. However, for purposes of the present invention, additions of copper greater than about 0.40 wt % are not effective. Large amounts of copper result in deteriorated hot workability and weldability. Copper, like nickel, is an austenite former that is readily retained in solid solution at the given ranges. Preferred amounts of copper range from about 0.20 wt % to about 0.40 wt %, and more preferably from about 0.25 wt % to about 0.35 wt %.

Chromium is an effective element for improving hardenability. A maximum amount of chromium provides proper weathering characteristics. Chromium additions sufficient for suitable hardenability and weathering characteristics of the steel include amounts of chromium in the range of from about 0.40 wt % to about 0.70 wt %, with a preferred range of from about 0.50 wt % to about 0.60 wt %, and a more preferred range of from about 0.55 wt % to about 0.60 wt %.

Nickel improves toughness as well as hardenability. When added in amounts of less than about 0.20%, there is no substantial effect. Nickel additions greater than about 0.70 wt % are not necessary to achieve the required characteristic of the present invention. Nickel is an austenite but not a ferrite former. Nickel imparts good toughness to the steel material at a high level of strength. In addition to increasing the strength and toughness of the steel, nickel counters the hot shortness caused by the copper component of the present invention. The nickel content preferably ranges from about 0.20 wt % to about 0.50 wt %, more preferably from about 0.25 wt % to about 0.35 wt %, and a most preferred range of from about 0.30 wt % to about 0.35 wt %.

An amount of boron from about 0.0015% or more is effective for fixing nitrogen before the steel is subjected to a hot rolling procedure. However, boron content above about 0.003% promotes the hot embrittlement of the resultant steel. Boron increases hardenability of the steel without a decrease in toughness and workability of steel, but should be protected against the formation of boron nitride through the addition of nitride formers, such as aluminum. The boron content preferably ranges from about 0.0015 wt % to about 0.003 wt %, more preferably from about 0.002 wt % to about 0.003 wt %, and most preferably from about 0.0025 wt % to about 0.003 wt %.

Titanium is a strong nitride former and acts to protect boron from boron nitride formation by combining with nitrogen in the molten steel. Titanium nitrides are effective at pinning austenite grain boundaries during reheating and thereby helping to control austenite grain growth. The titanium content preferably ranges from about 0.01 wt % to about 0.05 wt %, more preferably from about 0.015 wt % to about 0.03 wt %, and most preferably from about 0.02 wt % to about 0.025 wt %.

The niobium, sometimes referred to as columbium, is a strong carbonitride former and is added to retard austenite recrystallization during hot rolling. The strain induced precipitation of niobium carbonitrides pin austenite grains, preventing recrystallization resulting in finer austenite grain size prior to improve strength and toughness. Niobium is sometimes added alone or in combination with V to enhance the mechanical strength through precipitation hardening. The niobium content preferably ranges from about 0.03 wt % to about 0.06 wt %, more preferably from about 0.03 wt % to about 0.055 wt %, and most preferably form about 0.03 wt % to about 0.05 wt %.

Optional components of the ultra-low carbon weathering steel of the present invention include manganese (Mn), phosphorous (P), sulphur (S), silicon (Si), molybdenum (Mo), vanadium (V), aluminum (Al), and nitrogen (N).

The manganese content ranges from about 2.0 wt % or less. Manganese improves hardenability of the steel and increases its toughness. It may further aid niobium in retarding the recrystallization of austenite. Manganese promotes the formation of fine acicular ferrite and lower-bainite, and is effective for fixing sulfur and for preventing hot embrittlement of the steel. When present, manganese is an active deoxidizer that is capable of hardening the steel without impairing the weldability. However, in amounts in excess of 2.0%, manganese tends to stabilize the lower bainite in the as-hot-worked steel to give rise to a higher strength at a considerable expense in the ductility and toughness.

Phosphorous content of the present invention ranges from about 0.012 wt % or less. Phosphorus is a strengthening element that effectively increases the mechanical strength of the steel. However, excessive amounts of phosphorus, such as greater than about 0.012%, are detrimental to toughness.

Sulphur content of the steel may be present in amounts of from about 0.005 wt % or less. Sulfur commonly occurs as an impurity and is restricted to minimize sulfide inclusion "stringers" in the hot rolled plate which adversely affects the ductility and toughness of the steel in the long transverse and short transverse directions.

The silicon content may be present in amounts of from about 0.40 wt % or less. Silicon is a strengthening and deoxidation component for the steel. However, an excessive amount of silicon, such as greater than about 0.40%, is detrimental to toughness and welding properties.

Molybdenum content of the present invention ranges from about 0.50 wt % or less. Molybdenum improves hardenability and resistance to temper brittleness. When molybdenum is present, niobium is more effective in retarding the recrystallization of austenite. A maximum of 0.50 wt % molybdenum should be used as larger amounts cause martensite formation during welding, which is brittle and hence unacceptable. Molybdenum, like chromium, helps to strength the steel but also tends to impair the toughness when excessively used.

Vanadium may be present in the steel in amounts of from about 0.10 wt % or less. Vanadium improves strength of the steel due to the precipitation of carbides, but tends to enhance the weld-cracking. Vanadium may be included as a grain refiner. Amounts greater than about 0.10 wt % tend to have minimal affect in increasing strength, with nitrogen precipitating as vanadium nitride (VN).

Aluminum content of from about 0.03 wt % or less may be present in the steel. Aluminum enhances deoxidation of the steel and fixes nitrogen by forming aluminum nitride (AlN). Excessive amounts of aluminum cause increased aluminum oxide impurities in the steel, decreasing the degree of cleanness of the steel. When the content of nitrogen is larger than about 0.03 wt %, the excess amount of nitrogen is retained in the form of a solid solution in the steel. Aluminum controls grain size during processing.

A nitrogen content of from about 0.006 wt % or less may be present in the steel of the present invention without any substantial degradation of the characteristics of the steel.

Manufacture of the ultra-low carbon weathering steel of the present invention includes the steps of austenitizing a steel slab comprising a steel as herein described, conditioning the austenite microstructure of the steel slab at a deforming temperature between the austenitizing temperature and the austenite recrystallization stop temperature followed by deforming the austenite microstructure at a temperature below the austenite recrystallization stop temperature and above the $Ar_3$ temperature of the slab, deforming the slab to a minimum reduction ratio below the austenite recrystallization stop temperature of from about 2.5:1 or more to form a steel plate and cooling the steel plate to ambient temperature. This method of forming the ultra-low carbon weathering steel increases the toughness and strength of the resulting steel product.

The preparation of the steel slab can be accomplished by conventional slab-making methods, such as from ingot or a continuous casting methods. In the process of the present invention, the steel slab is heated to a temperature between from about 2012° F. to about 2350° F. and hot rolled to condition the austenite microstructure. The temperature range for hot rolling is below the austenitizing temperature and above the austenite recrystallization stop temperature. The austenite conditioning step continues at a temperature below the austenite recrystallization stop temperature and above the $Ar_3$ temperature of the steel slab.

The austenite conditioning is performed such that the austenite phase is allowed to recrystallize between rolling passes. Successive rolling plus recrystallization events result in a refinement of the austenite grain size after each rolling pass, which is effective in obtaining a finer as-cooled grain size. This method of austenite conditioning, commonly called recrystallization controlled rolling (RCR), improves the strength and toughness of hot rolled steels. RCR may be performed in the temperature range between the austenite grain coarsening temperature and the austenite recrystallization stop temperature. Controlled cooling techniques such as accelerated cooling following RCR is an effective method of obtaining high strength with reduced alloy content, as it lowers the ferrite transformation temperature. Consequently, the final ferrite grain size is smaller and/or the fraction of bainite is higher than compared to a plate of the same thickness that is air-cooled. Controlled rolling (CR) is a low temperature austenite conditioning method that is performed at temperatures below the recrystallization stop temperature and typically above the $Ar_3$ temperature. Controlled cooling immediately following CR helps to improve strength and toughness achieving fine ferrite grain sizes. RCR can be combined with CR to achieve the finest possible austenite grain structures.

Steel slabs within the meaning of the present invention include ingot configurations of the steel, the slab product from the ingot configurations, continuous casing of the steel and/or other types of steel configurations. Preferred temperatures for austenitizing the steel slab range from about 2012° F. to about 2350° F., with more preferred temperatures ranging from about 2012° F. to about 2300° F., and most preferred temperatures ranging from about 2050° F. to about 2250° F.

The importance of retarding austenite recrystallization during the latter stages of hot rolling is to obtain a predominantly heavily deformed austenite phase. A total reduction in thickness of at least 30% while within the temperature range of between the austenite recrystallization stop temperature and the $Ar_3$, such as between 1700° F. to about 1400° F. accomplishes this. The reduction in thickness may be done in one or several passes. Preferably the total reduction in thickness is at least 50% within a preferred temperature range of 1600° F. to about 1400° F. No ferrite is formed intentionally during hot rolling in the controlled process of the present invention. At higher rolling temperatures, or in steels not containing the critical niobium addition, deformed grains immediately recrystallize during hot rolling after each rolling pass into undeformed or stress-free new grains. However, in the present invention, substantial recrystallization does not occur because of the composition of the steel. Hence, at the completion of hot rolling the austenite grains are highly deformed. During cooling after completion of hot rolling the deformed austenite structure transforms to ferrite in the usual manner, but the ferrite is predominantly fine grained and acicular rather than polygonal. At sufficient cooling rates, low carbon bainite may form. The high strength and toughness of the present steel is attributed to the predominantly lower-bainitic microstructure. Conditioning of the austenite microstructure includes rolling the steel slab.

Preferred minimum reduction ratios range from about 2.5:1 or more, with more preferred ratios from about 2.85:1 or more, and most preferred ratios from about 3.0:1. This method of forming the ultra-low carbon weathering steel increases the toughness and strength of the resulting steel product.

The step of cooling the steel plate to ambient temperature preferably includes a rapid cooling rate of from about 3.0° F./sec to about 36° F./sec, with more preferred cooling rates from about 4.0° F./sec to about 20° F./sec, and most preferred cooling rates of from about 7.0° F./sec to about 10° F./sec, when measured between the start cooling temperature and the finish cooling temperature, such as from about 1470° F. and about 1020° F. Rapid cooling may be performed by heat sinks, such as water or other known evaporating liquids, including conventional cooling methods, for example, a gas-jet, a gas-water jet, a metallic roll contacting, a hot water-quenching, or a water-quenching, with the most appropriate means for cooling determinable by those skilled in the art. The cooling rate of the steel plate to ambient temperature is significant at steel plate temperatures between about 1470° F. to about 1020° F., as the steel plate achieves an ambient temperature of from about 65° F. to about 85° F. Below the temperature of about 1020° F., cooling rates may progress gradually, i.e., using an air cooling system, to further cool the steel plate. When the cooling rate is less than 3.0° F./sec, over-saturation of carbon in the resultant steel becomes unsatisfactorily low.

The strength of as-cooled steel can be evaluated in terms of hardenability. For most steels, it is found that strength increases with hardenability. For the present invention, boron addition achieves the necessary hardenability. On the other hand, toughness is improved by refining the grain size and reducing the alloy content, particularly carbon content. Thus, for the purposes of the present invention, proper austenite conditioning by utilizing RCTR, CR and accelerated cooling and the herein described ultra-low carbon levels achieves high toughness.

The ultra-low carbon weathering steel of the present invention provides from about 0.2% or more offset yield strength of 65,000 psi, and Charpy V-Notch energy (CVE) values of from about 30 ft-lbs or more at −30° F.

EXAMPLE 1

A steel of the following composition by weight: C 0.025%, Cu 0.367%, Cr 0.55%, Ni 0.3%, B 0.003%, Si 0.25%, Mn 1.85%, S 0.004%, P 0.012%, Al 0.025%, N 0.008%, Ti 0.025%, Nb 0.05%, balance essentially iron, was formed from the following process: A 5 inch slab having the identified components was reheated to 2050° F. and held for a time at temperature, i.e., soaked, sufficiently to accomplish the desired phase transformation. The slab was rolled to an intermediate thickness of approximately 2.45 inches between the temperatures from about 1975° F. and 1870° F. The slab of intermediate thickness was then air cooled to 1580° F. whereupon rolling commenced until final plate thickness of about 0.77 inch was reached. The final rolling sequence was performed between the temperatures from about 1580° F. and 1490° F. Immediately after the final rolling sequence was completed, the plate was subjected to controlled cooling at a rate of about 3° F./sec, as measured in the temperature between from about 1470° F. and 1020° F., down to a temperature of about 1020° F. After the temperature of the plate reached 1020° F., the controlled cooling process was ceased and the plate was allowed to air cool to ambient temperature.

EXAMPLE 2

A steel of the following composition by weight: C 0.025%, Cu 0.36%, Cr 0.55%, Ni 0.3%, B 0.003%, Si 0.25%, Mn 1.85%, S 0.004%, P 0.012%, Al 0.025%, N 0.008%, Ti 0.025%, Nb 0.05%, balance essentially iron, was formed from the following process: A 5 inch slab having the identified components was reheated to 2050° F. and held for a time at temperature, i.e., soaked, sufficiently to accomplish the desired phase transformation. The slab was rolled to an intermediate thickness of approximately 2.45 inches between the temperatures from about 1975° F. and 1870° F. The slab of intermediate thickness was then air cooled to 1580° F. whereupon rolling commenced until final plate thickness of about 0.77 inch was reached. The final rolling sequence was performed between the temperatures from about 1580° F. and 1490° F. Immediately after the final rolling sequence was completed, the plate was subjected to controlled cooling at a rate of about 7° F./Sec as measured in the temperature between from about 1470° F. and 1020° F., down to a temperature of about 1020° F. After the temperature of the plate reached 1020° F. After the temperature of the plate reached 1020° F., the controlled cooling process was ceased and the plate was allowed to air cool to ambient temperature.

EXAMPLE 3 (prophetic)

A steel of the following composition by weight: C 0.025%, Cu 0.036%, Cr 0.55%, Ni 0.3%, B 0.0025%, Si 0.25%, Mn 1.85%, S 0.004%, P 0.012%, Al 0.025%, N 0.008%, Ti 0.025%, Nb 0.05%, balance essentially iron, is formed from the following process: A 4 inch slab having the identified components is reheated to about 2350° F. and soaked for a time sufficient to accomplish the desired phase transformation. The slab is rolled to an intermediate thickness between the temperatures from about 2350° F. and 1830° F. The slab of intermediate thickness is then air cooled to 1650° F. whereupon rolling commenced until final plate thickness is reached. The final rolling sequence is performed between the temperatures from about 1650° F. and 1500° F. Immediately after the final rolling sequence is completed, the plate is subjected to controlled cooling at a rate of about 3° F./sec, as measured in the temperature between from about 1470° F. and 1020° F., down to a temperature of about 1020° F. After the temperature of the plate reaches 1020° F., the controlled cooling process is ceased and the plate is allowed to cool naturally to ambient temperature.

EXAMPLE 4 (prophetic)

A steel of the following composition by weight: C 0.025%, Cu 0.36%, Cr 0.55%, Ni 0.3%, B 0.0025%, Si 0.25% Mn 1.85%, S 0.004%, P 0.012%, Al 0.025%, N 0.008%, Ti 0.024%, Nb 0.03%, balance essentially iron, is formed from the following process: A 6 inch slab having the identified components is reheated to about 2350° F. and soaked for a time sufficient to accomplish the desired phase transformation. The slab is rolled to an intermediate thickness between the temperatures from about 2350° F. and 1830° F. The slab of intermediate thickness is then air cooled to 1650° C. whereupon rolling commenced until final plate thickness is reached. The final rolling sequence is performed between the temperatures from about 1650° F. and 1500° F. Immediately after the final rolling sequence is completed, the plate is subjected to controlled cooling at a rate of about 7° F./sec as measured in the temperature between from about 1470° F. and 1020° F., down to a temperature of about 1020° F. After the temperature of the plate reaches 1020° F., the controlled cooling process is ceased and the plate is allowed to cool naturally to ambient temperature.

EXAMPLE 5 (prophetic)

A steel of the following composition by weight: C 0.02%, Cu 0.35%, Cr 0.55%, Ni 0.3%, B 0.003%, Si 0.25%, Mn 1.85%, S 0.004%, P 0.012%, Al 0.025%, N 0.008%, Ti 0.02%, Nb 0.03%, balance essentially iron, is formed from the following process: A 5 inch slab having the identified components is reheated to about 2012° F. and soaked for a time sufficient to accomplish the desired phase transformation. The slab is rolled to an intermediate thickness between the temperatures from about 2012° F. and 1830° F. The slab of intermediate thickness is then air cooled to 1650° F. whereupon rolling commenced until final plate thickness is reached. The final rolling sequence is performed between the temperatures from about 1650° F. and 1500° F. Immediately after the final rolling sequence is completed, the plate is subjected to controlled cooling at a rate of about 15° F./sec as measured in the temperature between from about 1470° F. and 930° F., down to a temperature of about 930° F. After the temperature of the plate reaches 930° F., the controlled cooling process is ceased and the plate is allowed to air cool to ambient temperature.

EXAMPLE 6 (prophetic)

A steel of the following composition by weight: C 0.02%, Cu 0.35%, Cr 0.55%, Ni 0.3%, B 0.003%, Si 0.25%, Mn 1.85%, S 0.004%, P 0.012%, Al 0.025%, N 0.008%, Ti 0.02%, Nb 0.03%, balance essentially iron, is formed from the following process: A 5 inch slab having the identified components is reheated to about 2012° F. and soaked for a time sufficient to accomplish the desired phase transformation. The slab is rolled to an intermediate thickness between the temperatures from about 2012° F. and 1830° F. The slab of intermediate thickness is then air cooled to 1650° F. whereupon rolling commenced until final plate thickness is reached. The final rolling sequence is performed between the temperature from about 1650° F. and 1500° F. Immediately after the final rolling sequence is completed, the plate is subjected to controlled cooling at a rate of about 36° F./sec as measured in the temperature between from about 1470° F. and 930° F., down to a temperature of about 930° F. After the temperature of the plate reaches 930° F., the controlled cooling process is ceased and the plate is allowed to air cool to ambient temperature.

Lower carbon and lower carbon equivalent values result in improved weldability. Typically, high strength steels require pre-heating before welding can be performed to avoid heat affected zone (HAZ) cracking. The lower hardenability of this steel resulting from the ultra low carbon levels described herein virtually eliminates the need for pre-heating and greatly reduce the potential for HAZ cracking. HAZ cracking requires costly weldment rework. The steel is provided in the as-rolled or as-cooled condition allowing very long plates to be supplied to fabricators. This steel uniquely uses boron to improve hardenability along with controlled rolling and accelerated cooling to meet the properties in the as-cooled condition and also because it meets the requirements of a weathering steel.

The foregoing summary, description, and examples of the present invention are not intended to be limiting, but are only exemplary of the inventive features which are defined in the claims.

What is claimed is:

1. An ultra-low carbon weathering steel comprising:

a steel having a carbon content of from about 0.015 wt % to about 0.035 wt %; a copper content of from about 0.20 wt % to not more than 0.40 wt %; a chromium content of from about 0.40 wt % to about 0.70 wt %; a nickel content of from about 0.20 wt % to about 0.50 wt %; a titanium content of from about 0.01 wt % to about 0.05 wt %; a niobium content of from about 0.03 wt % to about 0.06 wt %; a boron content of from about 0.0015 wt % to about 0.03 wt %; a manganese content of from about 2.0 wt % or less; a phosphorous content of from about 0.012 wt % or less; a sulphur content of from about 0.005 wt % or less; a silicon content of from about 0.40 wt % or less; a molybdenum content of from about 0.50 wt % or less; a vanadium content of from about 0.10 wt % or less; an aluminum content of from about 0.03 wt % or less; and a nitrogen content of from about 0.006 wt % or less.

2. The ultra-low carbon weathering steel of claim 1, wherein the carbon content ranges from about 0.015 wt % to about 0.025 wt %.

3. The ultra-low carbon weathering steel of claim 1, wherein the copper content ranges from about 0.25 wt % to about 0.35 wt %.

4. The ultra-low carbon weathering steel of claim 1, wherein the chromium content ranges from about 0.50 wt % to about 0.60 wt %.

5. The ultra-low carbon weathering steel of claim 1, wherein the nickel content ranges from about 0.25 wt % to about 0.35 wt %.

6. The ultra-low carbon weathering steel of claim 1, wherein the boron content ranges from about 0.002 wt % to about 0.003 wt %.

7. An ultra-low carbon weathering steel product made by the process comprising:

austenitizing a steel slab comprising a steel having a carbon content of from about 0.015 wt % to about 0.035 wt %; a copper content of from about 0.20 wt % to not more than 0.40 wt %; a chromium content of from about 0.40 wt % to about 0.70 wt %; a nickel content of from about 0.20 wt % to about 0.50 wt %; a titanium content of from about 0.01 wt % to about 0.05 wt %; a niobium content of from about 0.03 wt % to about 0.06 wt %; a boron content of from about 0.0015 wt % to about 0.03 wt %; a manganese content of from about 2.0 wt % or less; a phosphorous content of from about 0.012 wt % or less; a sulphur content of from about 0.005 wt % or less; a silicon content of from about 0.40 wt % or less; a molybdenum content of from about 0.50 wt % or less; a vanadium content of from about 0.10 wt % or less; an aluminum content of from about 0.03 wt % or less; and a nitrogen content of from about 0.006 wt % or less.

conditioning the austenite microstructure of the steel slab at a deforming temperature between the austenitizing temperature and the austenite recrystallization stop temperature followed by deforming the austenite microstructure at a temperature below the austenite recrystallization stop temperature and above the $Ar_3$ temperature of the slab;

deforming the slab to a minimum reduction ratio below the austenite recrystallization stop temperature of from about 2.5:1 or more to form a steel plate; and cooling the steel plate to ambient temperature.

8. The ultra-low carbon weathering steel product of claim 7, wherein the step of austenitizing the steel slab comprising a temperature of from about 2012° F. to about 2350° F.

9. The ultra-low carbon weathering steel product of claim 7, wherein the step of conditioning the austenite microstructure comprises rolling the slab.

10. The ultra-low carbon weathering steel product of claim 9, wherein the slab is rolled to an intermediate thickness.

11. The ultra-low carbon weathering steel product of claim 7, wherein the step of cooling the steel plate to ambient temperature comprises a cooling rate of from about 3.0° F. per second to about 36° F. per second.

12. The ultra-low carbon weathering steel product of claim 11, wherein the step of cooling the steel plate to ambient temperature comprises a cooling rate of from about 3.0° F. per second to about 36° F. per second through the temperature of from about 1470° F. to about 930° F. of the steel plate.

13. The ultra-low carbon weathering steel product of claim 11, wherein the step of cooling the steel plate to ambient temperature comprises air cooling at a steel plate temperature of from about 1020° F. or less.

14. The ultra-low carbon weathering steel product of claim 7, wherein the ultra-low carbon weathering steel product comprises from about 0.2% or more offset yield strength of 65,000 psi.

15. The ultra-low carbon weathering steel product of claim 7, wherein the ultra-low carbon weathering steel product comprises a Charpy V-Notch energy (CVE) value of from about 30 ft-lbs or more at −30° F.

16. The ultra-low carbon weathering steel of claim 1, wherein the copper content is not less than 0.20 wt %.

17. The ultra-low carbon weathering steel of claim 1, wherein the chromium content is not more than 0.70 wt %.

18. The ultra-low carbon weathering steel of claim 1, wherein the chromium content is not less than 0.40 wt %.

19. The ultra-low carbon weathering steel of claim 1, wherein the copper content is not less than 0.20 wt %, the chromium content is not less than 0.40 wt % and not more than 0.70 wt %.

20. The ultra-low carbon weathering steel of claim 7, wherein the copper content is not less than 0.20 wt %.

21. The ultra-low carbon weathering steel of claim 7, wherein the chromium content is not more than 0.70 wt %.

22. The ultra-low carbon weathering steel of claim 7, wherein the chromium content is not less than 0.40 wt %.

23. The ultra-low carbon weathering steel of claim 7, wherein the copper content is not less than 0.20 wt %, the chromium content is not less than 0.40 wt % and not more than 0.70 wt %.

* * * * *